US011388793B2

(12) United States Patent
Cao et al.

(10) Patent No.: US 11,388,793 B2
(45) Date of Patent: Jul. 12, 2022

(54) DIMMABLE LIGHTING APPARATUS

(71) Applicant: CH LIGHTING TECHNOLOGY CO., LTD., Shaoxing (CN)

(72) Inventors: Shengjun Cao, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 17/359,658

(22) Filed: Jun. 28, 2021

(65) Prior Publication Data

US 2022/0039227 A1 Feb. 3, 2022

Related U.S. Application Data

(63) Continuation of application No. PCT/CN2020/137391, filed on Dec. 17, 2020.

(30) Foreign Application Priority Data

Jul. 28, 2020 (CN) ..... 202021523817.4
Oct. 22, 2020 (CN) ..... 202011141423.7

(51) Int. Cl.
*H05B 45/14* (2020.01)
*H05B 45/345* (2020.01)

(52) U.S. Cl.
CPC ..... *H05B 45/14* (2020.01); *H05B 45/345* (2020.01)

(58) Field of Classification Search
CPC ..... H05B 47/10; H05B 45/14; H05B 45/30; H05B 45/345; H05B 45/36
See application file for complete search history.

(56) References Cited

U.S. PATENT DOCUMENTS 4,947,054 A * 8/1990 Flowers ..... H01H 3/0213 338/200
2008/0024074 A1* 1/2008 Mosebrook ..... H05B 47/10 315/291

(Continued)

FOREIGN PATENT DOCUMENTS

CN 203554741 U * 4/2014
CN 203554741 U 4/2014

(Continued)

OTHER PUBLICATIONS

International Search Report issued in corresponding International application No. PCT/CN2020/137391, dated Mar. 30, 2021.

(Continued)

*Primary Examiner* — Abdullah A Riyami
*Assistant Examiner* — Syed M Kaiser

(57) ABSTRACT

The present invention provides a dimmable lighting apparatus, comprising a light emitting circuit and a driving circuit coupled with the light emitting circuit. The driving circuit comprises a rectifier module, a filtering module coupled between the light emitting circuit and the rectifier module, a constant current module coupled between the filtering module and the light emitting circuit, and a dimming module. In particular, the dimming module is configured to receive a driving signal supplied to the light emitting circuit from the constant current module, and feed the driving signal back to the constant current module to adjust an output power of the constant current module.

14 Claims, 6 Drawing Sheets

(56) References Cited

U.S. PATENT DOCUMENTS

| | | | | |
|---|---|---|---|---|
| 2014/0055052 | A1* | 2/2014 | Zudrell-Koch | H05B 45/31 315/246 |
| 2015/0373792 | A1 | 12/2015 | Kim et al. | |

FOREIGN PATENT DOCUMENTS

| | | | | | |
|---|---|---|---|---|---|
| CN | 103634979 | B | * | 1/2017 | H05B 33/0815 |
| CN | 107666736 | A | * | 2/2018 | H05B 33/0842 |
| WO | WO-2018090660 | A1 | * | 5/2018 | H05B 33/0842 |
| WO | WO-2019078127 | A1 | * | 4/2019 | H02M 3/155 |

OTHER PUBLICATIONS

Written Opinion of the International Searching Authority for No. PCT/CN2020/137391.

* cited by examiner

DIMMABLE LIGHTING APPARATUS

TECHNICAL FIELD

The present invention relates to a lighting apparatus, in particular to a dimmable lighting apparatus.

BACKGROUND

Led lighting is widely used in various industries, with advantages of long life and high efficiency. With the development of lighting technology and the increasing requirement for energy saving and environmental protection, the demand for a dimmable LED lamp is increasing. However, the dimming modules of the existing LED lamps are complex, requiring a plurality of electric components, which results in a relatively high cost.

SUMMARY

In view of the problems of the prior art, embodiments of the present invention provide an improved dimmable lighting apparatus to eliminate or at least alleviate at least a part of the deficiencies of the prior art.

In an exemplary embodiment of the present invention, a dimmable lighting apparatus is provided, comprising a light emitting circuit and a driving circuit coupled with the light emitting circuit. The driving circuit comprises a rectifier module, a filtering module coupled between the light emitting circuit and the rectifier module, a constant current module coupled between the filtering module and the light emitting circuit, and a dimming module. The dimming module is configured to receive a driving signal supplied to the light emitting circuit from the constant current module, and feed the driving signal back to the constant current module to adjust an output power of the constant current module.

In an exemplary embodiment of the present invention, the dimming module comprises a first voltage dividing unit, a filtering unit, a first voltage stabilizing unit and an amplifying unit, wherein the first voltage dividing unit is configured to collect the driving signal from the light emitting circuit, the filtering unit is configured to filter the collected driving signal, the amplifying unit is configured to amplify and feed back the filtered driving signal to the constant current module, and the first voltage stabilizing unit is configured to stabilize an input voltage of the amplifying unit.

In an exemplary embodiment of the present invention, the first voltage dividing unit comprises a first resistor, a second resistor, and a third resistor, and wherein a first terminal of the first resistor is coupled with the light emitting circuit, a second terminal of the first resistor is coupled with a first terminal of the second resistor, a second terminal of the second resistor is coupled with a first node, a first terminal of the third resistor is coupled with the first node, and the second terminal of the third resistor is coupled to the ground. The filtering unit comprises a fourth resistor, a first capacitor, and a second capacitor, and wherein a first terminal of the fourth resistor is coupled with the first node, a second terminal of the fourth resistor is coupled with a second node, a first terminal of the first capacitor is coupled with the first node, a second terminal of the first capacitor is coupled to the ground, a first terminal of the second capacitor is coupled with the second node, and a second terminal of the second capacitor is coupled to the ground. The first voltage stabilizing unit comprises a first Zener diode, and wherein a positive pole of the first Zener diode is coupled to the ground, and a negative pole of the first Zener diode is coupled with the second node. The amplifying unit comprises a first transistor, and wherein a base of the first transistor is coupled with the second node, a first pole of the first transistor is coupled to the ground, and a second pole of the first transistor is coupled with the constant current module.

In an exemplary embodiment of the present invention, the first voltage dividing unit comprises a fifth resistor, a sixth resistor, a seventh resistor, and an eighth resistor, and wherein a first terminal of the fifth resistor is coupled with the light emitting circuit, a second terminal of the fifth resistor is coupled with a first terminal of the sixth resistor, a second terminal of the sixth resistor is coupled with a third node, a first terminal of the seventh resistor is coupled with the third node, a second terminal of the seventh resistor is coupled with a fourth node, a first terminal of the eighth resistor is coupled with the fourth node, and a second terminal of the eighth resistor is coupled to the ground. The filtering unit comprises a third capacitor, and wherein a first terminal of the third capacitor is coupled with the fourth node, and a second terminal of the third capacitor is coupled to the ground. The first voltage stabilizing unit comprises a second Zener diode, and wherein a positive pole of the second Zener diode is coupled to the ground, and a negative pole of the second Zener diode is coupled with the third node. The amplifying unit comprises a second transistor, and wherein a base of the second transistor is coupled with the fourth node, a first pole of the second transistor is coupled to the ground, and a second pole of the second transistor is coupled with the constant current module.

In an exemplary embodiment of the present invention, the constant current module comprises a switch unit, a control unit coupled between the switch unit and the light emitting circuit, and an energy storage and freewheeling unit coupled between the control unit and the light emitting circuit.

In an exemplary embodiment of the present invention, the constant current module further comprises a second voltage dividing unit and a second voltage stabilizing unit, and wherein a first terminal of the second voltage dividing unit is coupled between the light emitting circuit and the energy storage and freewheeling unit, and a second terminal of the second voltage dividing unit is coupled with a first terminal of the second voltage stabilizing unit, and a second terminal of the second voltage stabilizing unit is coupled with the control unit.

In an exemplary embodiment of the present invention, the second voltage dividing unit comprises a ninth resistor, a tenth resistor, and an eleventh resistor, and wherein a first terminal of the ninth resistor is coupled between the light emitting circuit and the energy storage and freewheeling unit, a second terminal of the ninth resistor is coupled with a first terminal of the tenth resistor, a second terminal of the tenth resistor is coupled with a fifth node, a first terminal of the eleventh resistor is coupled with the fifth node, and the second terminal of the eleventh resistor is coupled with a sixth node. The second voltage stabilizing unit comprises a fourth capacitor, and wherein a first terminal of the fourth capacitor is coupled with the control unit, and a second terminal of the fourth capacitor is coupled with the fifth node.

In an exemplary embodiment of the present invention, the energy storage and freewheeling unit comprises a first diode, a first inductor, a fifth capacitor and a twelfth resistor, and wherein a positive pole of the first diode is coupled with the control unit, a negative pole of the first diode is coupled with the light emitting circuit, a first terminal of the first inductor is coupled with the control unit, a second terminal of the first inductor is coupled with the light emitting circuit, a first terminal of the fifth capacitor is coupled with the light emitting circuit, and a second terminal of the fifth capacitor is coupled with a first terminal of the twelfth resistor, and a second terminal of the twelfth resistor is coupled with the control unit.

In an exemplary embodiment of the present invention, the switch unit comprises a power MOS transistor, and the power MOS transistor is integrated in the control unit.

In an exemplary embodiment of the present invention, the rectifier module comprises a second diode, a third diode, a sixth capacitor, a seventh capacitor, a first adjustable resistor, and a bridge rectifying circuit unit, and wherein an input terminal of the second diode is coupled with a first terminal of the sixth capacitor, a first terminal of the first adjustable resistor, and an output terminal of the third diode, an output terminal of the second diode is coupled with an output terminal of the bridge rectifying circuit unit, an input terminal of the third diode is coupled to the ground, a second terminal of the sixth capacitor is coupled with a second terminal of the first adjustable resistor, a first terminal of the seventh capacitor, and a first input terminal of the bridge rectifying circuit unit, a second terminal of the seventh capacitor is coupled with a second input terminal of the bridge rectifying circuit unit, and a third input terminal of the bridge rectifying circuit unit is coupled to the ground.

In an exemplary embodiment of the present invention, the filtering module comprises a fourth diode, an eighth capacitor, a ninth capacitor, a thirteenth resistor, a second inductor, and a second adjustable resistor, and wherein an input terminal of the fourth diode is coupled with a first terminal of the eighth capacitor, an output terminal of the fourth diode is coupled with a first terminal of the second adjustable resistor, and a first terminal of the ninth capacitor, a second terminal of the eighth capacitor is coupled with a first terminal of the thirteenth resistor, and a first terminal of the second inductor, and a second terminal of the ninth capacitor is coupled with a second terminal of the second inductor, a second terminal of the thirteenth resistor, and a second terminal of the second adjustable resistor.

In an exemplary embodiment of the invention, the lighting apparatus comprises a live input terminal, a first neutral input terminal and a second neutral input terminal, and wherein the live input terminal and the first neutral input terminal are located on a first side of the lighting apparatus, and the second neutral input terminal is located on a second side of the lighting apparatus, the first side being opposite to the second side, and wherein the live input terminal is configured to cooperate with the first neutral input terminal to supply power to the lighting apparatus at single end and to cooperate with the second neutral input terminal to supply power to the lighting apparatus at two ends.

In an exemplary embodiment of the present invention, the driving circuit further comprises a mounted detection circuit coupled between the rectifier module and the filtering module, and wherein the mounted detection circuit is configured to detect an electric signal abnormality in the driving circuit in a case where the lighting apparatus is powered at two ends, and to turn off the driving circuit in response to the detected abnormal electric signal.

In an exemplary embodiment of the present invention, the lighting apparatus is adaptable to a Triac dimmer.

In an exemplary embodiment of the present invention, the lighting apparatus is an LED lamp.

In an exemplary embodiment of the present invention, the LED lamp comprises a lamp body and end caps located at two ends of the lamp body, and each of the end caps is provided with pins.

It should be understood that the above general description and the following detailed description are only exemplary and explanatory and are not intended to limit the invention in any way.

BRIEF DESCRIPTION OF THE DRAWINGS

The above and further aspects of the invention will be described in more detail with reference to the accompanying drawings, which illustrate embodiments of the invention, but are not necessarily drawn to scale, and should be focused on the illustrated principles of the invention, in which, FIG. 1 schematically illustrates a block diagram of a lighting apparatus according to an embodiment of the invention.

The same reference numeral throughout the drawings refers to the same part.

Some embodiments of the present invention have been illustrated through the above drawings, which will be described in more detail hereinafter. These drawings and the related description are not intended to limit the scope of the inventive concept in any manner, but to explain the inventive concept for those skilled in the art with reference to specific embodiments.

DESCRIPTION OF THE EMBODIMENTS

In order to make the purposes, technical solutions and advantages of the embodiments of the present invention more clear, the technical solutions of the embodiments of the present invention will be described clearly and completely with reference to the drawings of the embodiments of the present invention. It will be apparent that the described embodiments are some, but not all, embodiments of the present invention. Based on the described embodiments of the present invention, all other embodiments obtained by those skilled in the art without creative labour fall within the scope of protection of the present invention.

With the development of society, it is necessary for the lighting apparatus to have the function of dimming. On the one hand, the application of the dimming technology will reduce energy consumption and save power for lighting. On the other hand, the application of the dimming technology will reduce the output power, which will significantly improve the working situation of the lighting apparatus and increase the service life of the lighting apparatus.

Among various dimming applications, Triac dimmer is a typical dimmer widely used in traditional incandescent lamps, halogen lamps, fluorescent lamps, and the like. Compared with traditional lamps, LED lamp has become the major illumination source because of its advantages such as high luminous efficiency, long life, energy saving and environmental protection. Therefore, there exists a demand in the art to replace traditional incandescent lamps, halogen lamps, fluorescent lamps and the like with LED lamps. Driven by this demand, it is necessary to provide an LED lighting apparatus that can be well adapted to the existing Triac dimmers.

Figure 9:
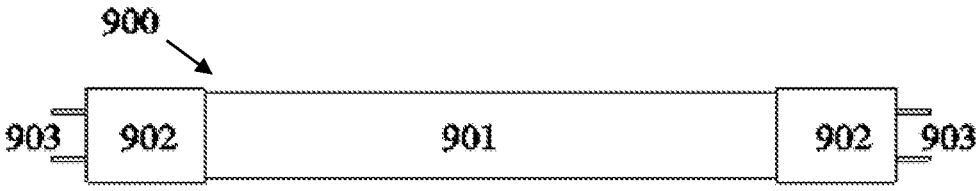
FIG. 9 schematically illustrates a schematic view of a typical LED lamp.

As shown in FIG. 9, a typical LED lamp 900 generally includes a lamp body 901 and end caps 902 at two ends of the lamp body 901. Each end cap 902 is provided with two pins 903 for connecting with an external power source. The lamp body 901 is provided with an LED light strip as a light emitting module and a driving circuit therein. The driving circuit converts the input external alternating current into a constant direct current and outputs the direct current to the LED light strip, so that the LED light bar emits light.

Typically, a dimmable LED lamp adapted to the Triac dimmer is provided with a dimming module for detecting the phase change of the bus bar, forming a dimming signal input to a constant current module, and dimming the LED lamp by changing the reference voltage. However, the circuit of such dimming module has a complex structure, resulting in a relatively high cost of the LED lamp.

Figure 1:
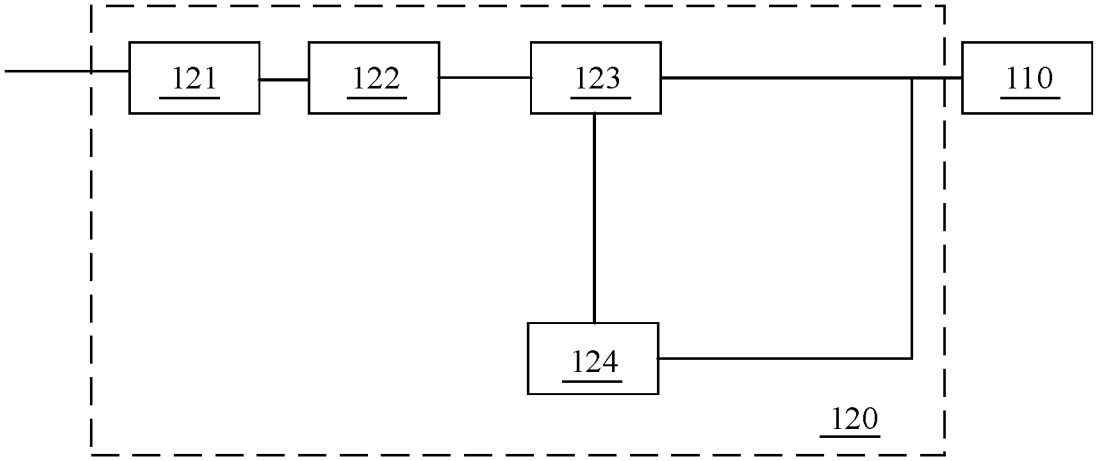

In view of this, an embodiment of the present invention provides a dimmable lighting apparatus, which, in particular, may be an LED lamp adapted to a Triac dimmer. As shown in FIG. 1, the lighting apparatus 100 includes a light emitting circuit 110 and a driving circuit 120 coupled with the light emitting circuit 110. The driving circuit 120 includes a rectifier module 121, a filtering module 122 coupled between the rectifier module 121 and the light emitting circuit 110, a constant current module 123 coupled between the filtering module 122 and the light emitting circuit 110, and a dimming module 124. The dimming module 124 is configured to receive a driving signal supplied to the light emitting circuit 110 from the constant current module 123 and feed the driving signal back to the constant current module 123 to adjust the output power of the constant current module 123.

In such a configuration, by adding the dimming module, it is possible to provide a feedback channel to feed back the driving signal supplied to the light emitting circuit to the constant current module, without greatly changing the internal structure of the driving circuit, so that the constant current module can sense the dimming operation of the dimmer, and accordingly adjust the driving signal supplied to the light emitting circuit, thereby reducing the risk of flash of the light emitting circuit, especially the LED lamp. At the same time, the structure of the original driving circuit can be maximally retained, so that the design and manufacturing cost are also low.

Figure 2:
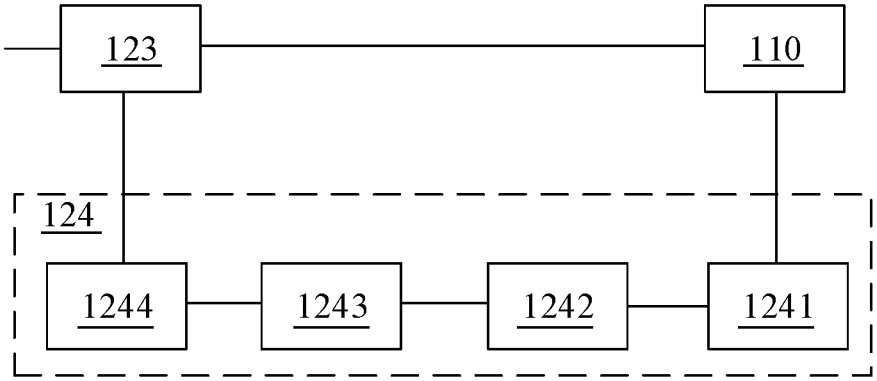
FIG. 2 schematically illustrates a block diagram of a dimming module according to an exemplary embodiment of the present invention.

FIG. 2 schematically illustrates a block diagram of the dimming module according to an exemplary embodiment of the present invention. As shown in FIG. 2, the dimming module 124 includes a first voltage dividing unit 1241, a filtering unit 1242, a first voltage stabilizing unit 1243, and an amplifying unit 1244. The first voltage dividing unit 1241 is configured to collect the driving signal from the light emitting circuit 110, the filtering unit 1242 is configured to filter the collected driving signal, the amplifying unit 1244 is configured to amplify the filtered driving signal and feed back the same to the constant current module 123, and the first voltage stabilizing unit 1243 is configured to stabilize the input voltage of the amplifying unit 1244.

By using the dimming module of such configuration, it is possible to collect the working condition of the constant current module, and to provide the constant current module with amplified and stabilized driving signal, so as to realize a negative feedback regulation for the constant current module, so that the constant current module can receive effective feedback and thus effectively adjust and stabilize the driving signal supplied to the light emitting circuit.

Figure 3A:
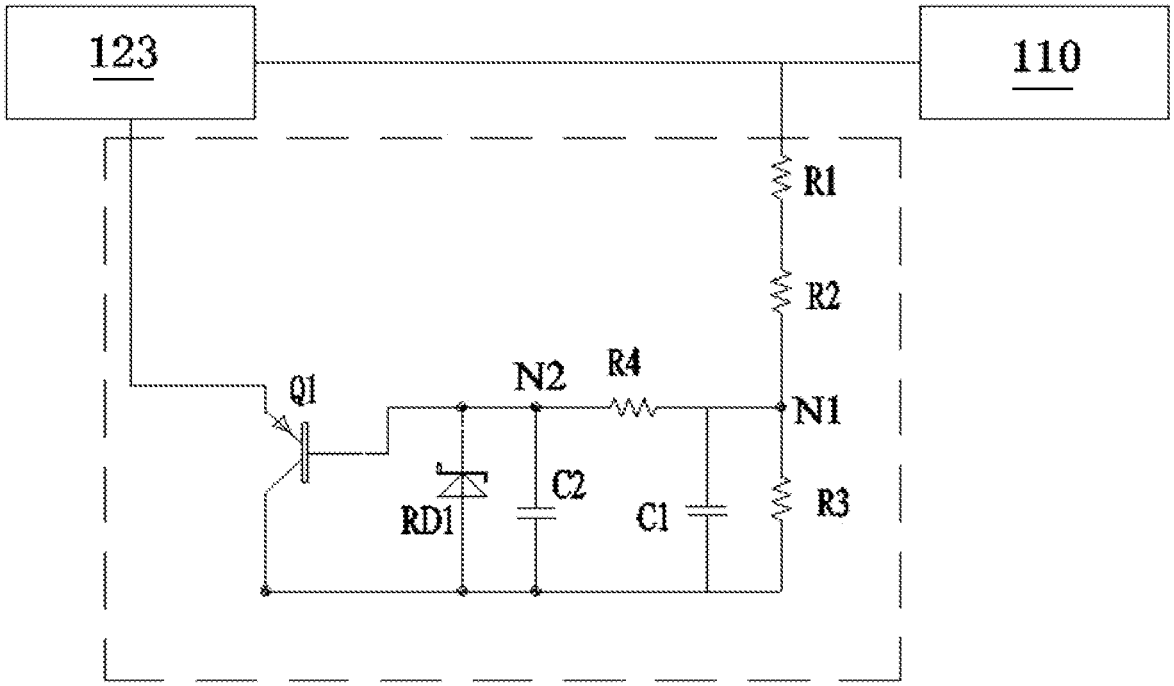
FIG. 3A schematically illustrates a circuit diagram of a dimming module according to an exemplary embodiment of the present invention.

In one exemplary embodiment, as shown in FIG. 3A, the first voltage dividing unit includes a first resistor R1, a second resistor R2 and a third resistor R3. A first terminal of the first resistor R1 is coupled with the light emitting circuit 110, a second terminal of the first resistor R1 is coupled with a first terminal of the second resistor R2, a second terminal of the second resistor R2 is coupled with a first node N1, a first terminal of the third resistor R3 is coupled with the first node N1, and a second terminal of the third resistor R3 is coupled to the ground. The filtering unit includes a fourth resistor R4, a first capacitor C1 and a second capacitor C2, wherein a first terminal of the fourth resistor R4 is coupled with the first node N1, a second terminal of the fourth resistor R4 is coupled with a second node N2, a first terminal of the first capacitor C1 is coupled with the first node N1, a second terminal of the first capacitor C1 is coupled to the ground, a first terminal of the second capacitor C2 is coupled with the second node N2, and a second terminal of the second capacitor C2 is coupled to the ground. The first voltage stabilizing unit includes a first Zener diode RD1, a positive pole of the first Zener diode RD1 is coupled to the ground, and a negative pole of the first Zener diode RD1 is coupled with the second node N2. The amplifying unit includes a first transistor Q1, wherein the base of the first transistor Q1 is coupled with the second node N2, a first pole of the first transistor Q1 is coupled to the ground, and a second pole of the first transistor Q1 is coupled with the constant current module 123.

In such an embodiment, the first voltage dividing unit divides the voltage with the three resistors connected in series, and outputs the voltage at the node between the second resistor and the third resistor as a feedback signal, which has already being filtered, stabilized and amplified, to the constant current module. This voltage dividing circuit has a simple structure, with relatively few components, and the resistance of each resistor or the number of voltage dividing resistors is allowed to be adjusted according to the specific situation.

Figure 3B:
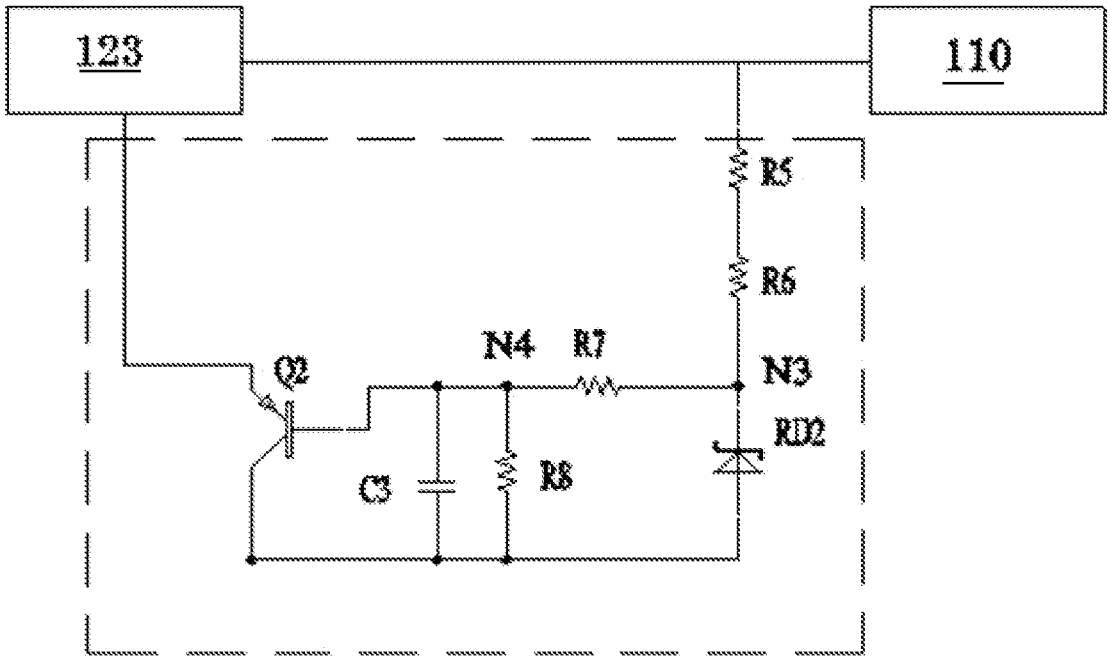
FIG. 3B schematically illustrates a circuit diagram of a dimming module according to another exemplary embodiment of the present invention.

Alternatively, in another exemplary embodiment, as shown in FIG. 3B, the first voltage dividing unit includes a fifth resistor R5, a sixth resistor R6, a seventh resistor R7, and an eighth resistor R8. A first terminal of the fifth resistor R5 is coupled with the light emitting circuit 110, a second terminal of the fifth resistor R5 is coupled with a first terminal of the sixth resistor R6, a second terminal of the sixth resistor R6 is coupled with a third node N3, a first terminal of the seventh resistor R7 is coupled with the third node N3, a second terminal of the seventh resistor R7 is coupled with a fourth node N4, a first terminal of the eighth resistor R8 is coupled with the fourth node N4, and a second terminal of the eighth resistor R8 is coupled to the ground. The filtering unit includes a third capacitor C3, wherein a first terminal of the third capacitor C3 is coupled with the fourth node N4, and a second terminal of the third capacitor C3 is coupled to the ground. The first voltage stabilizing unit includes a second Zener diode RD2, a positive pole of the second Zener diode RD2 is coupled to the ground, and a negative pole of the second Zener diode RD2 is coupled with the third node N3. The amplifying unit includes a second transistor Q2, wherein the base of the second transistor Q2 is coupled with the fourth node N4, a first pole of the second transistor Q2 is coupled to the ground, and a second pole of the second transistor Q2 is coupled with the constant current module 123.

Figure 4:
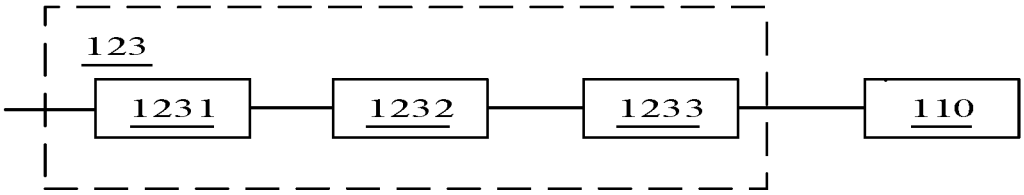
FIG. 4 schematically illustrates a block diagram of a constant current module according to an exemplary embodiment of the present invention.

FIG. 4 schematically illustrates a block diagram of a constant current module according to an exemplary embodiment of the present invention. As shown in FIG. 4, the constant current module 123 includes a switch unit 1231, a control unit 1232 coupled between the switch unit 1231 and the light emitting circuit 110, and an energy storage and freewheeling unit 1233 coupled between the control unit 1232 and the light emitting circuit 110.

Figure 5:
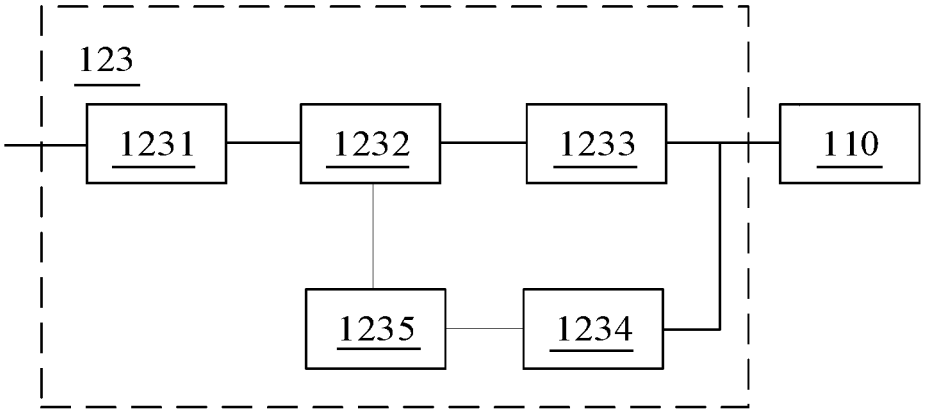
FIG. 5 schematically illustrates a block diagram of a constant current module according to another exemplary embodiment of the present invention.

In another exemplary embodiment of the present invention, as shown in FIG. 5, the constant current module 123 further includes a second voltage dividing unit 1234 and a second voltage stabilizing unit 1235. A first terminal of the second voltage dividing unit 1234 is coupled between the light emitting circuit 110 and the energy storage and freewheeling unit 1233, and a second terminal of the second voltage dividing unit 1234 is coupled with a first terminal of the second voltage stabilizing unit 1235, and a second terminal of the second voltage stabilizing unit 123 is coupled with the control unit 1232.

Figure 6:
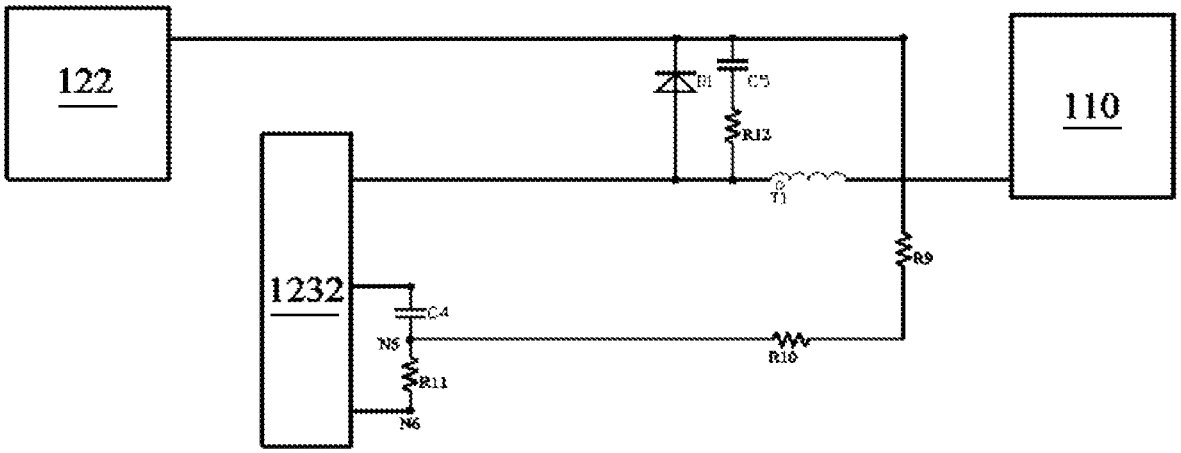
FIG. 6 schematically illustrates a circuit diagram of a constant current module according to an exemplary embodiment of the present invention.

Specifically, in an exemplary embodiment, as shown in FIG. 6, the second voltage dividing unit includes a ninth resistor R9, a tenth resistor R10, and an eleventh resistor R11. A first terminal of the ninth resistor R9 is coupled between the light emitting circuit 110 and the energy storage and freewheeling unit 1233, a second terminal of the ninth resistor R9 is coupled with a first terminal of the tenth resistor R10, a second terminal of the tenth resistor R10 is coupled with a fifth node N5, a first terminal of the eleventh resistor R11 is coupled with the fifth node N5, and a second terminal of the eleventh resistor R11 is coupled with a sixth node N6. The second voltage stabilizing unit includes a fourth capacitor C4, wherein a first terminal of the fourth capacitor C4 is coupled with the control unit 1232, and a second terminal of the fourth capacitor C4 is coupled with the fifth node N5.

Further, as shown in FIG. 6, the energy storage and freewheeling unit may include a first diode D1, a first inductor L1, a fifth capacitor C5, and a twelfth resistor R12. A positive pole of the first diode D1 is coupled with the control unit 1232, and a negative pole of the first diode D1 is coupled with the light emitting circuit 110. A first terminal of the first inductor L1 is coupled with the control unit 1232, and a second terminal of the first inductor L1 is coupled with the light emitting circuit 110. A first terminal of the fifth capacitor C5 is coupled with the light emitting circuit 110, a second terminal of the fifth capacitor C5 is coupled with a first terminal of the twelfth resistor R12, and a second terminal of the twelfth resistor R12 is coupled with the control unit 1232.

In an exemplary embodiment, the switch unit includes a power MOS transistor, and the power MOS transistor is optionally integrated in the control unit, thereby further improving the integration density of the entire driving circuit.

Figure 7:
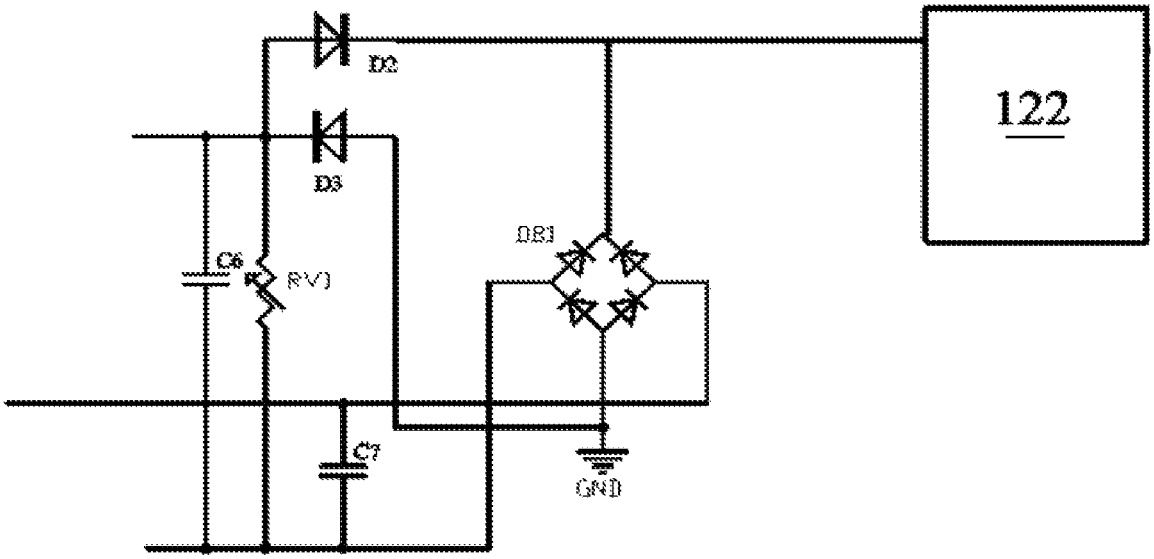
FIG. 7 schematically illustrates a circuit diagram of a rectifier module according to an exemplary embodiment of the present invention.

FIG. 7 schematically illustrates a circuit diagram of a rectifier module according to an exemplary embodiment of the present invention. As shown in FIG. 7, the rectifier module includes a second diode D2, a third diode D3, a sixth capacitor C6, a seventh capacitor C7, a first adjustable resistor RV1, and a bridge rectifying circuit unit DB. An input terminal of the second diode D2 is coupled with a first terminal of the sixth capacitor C6, a first terminal of the first adjustable resistor RV1, and an output terminal of the third diode D3. An output terminal of the second diode D2 is coupled with an output terminal of the bridge rectifying circuit unit DB, and an input terminal of the third diode D3 is coupled to the ground. A second terminal of the sixth capacitor C6 is coupled with a second terminal of the first adjustable resistor RV1, a first terminal of the seventh capacitor C7, and a first input terminal of the bridge rectifying circuit unit DB, a second terminal of the seventh capacitor C7 is coupled with a second input terminal of the bridge rectifying circuit unit DB, and a third input terminal of the bridge rectifying circuit unit DB is coupled to the ground. As shown in FIG. 7, the bridge rectifying circuit unit DB is composed of four diodes.

Figure 8:
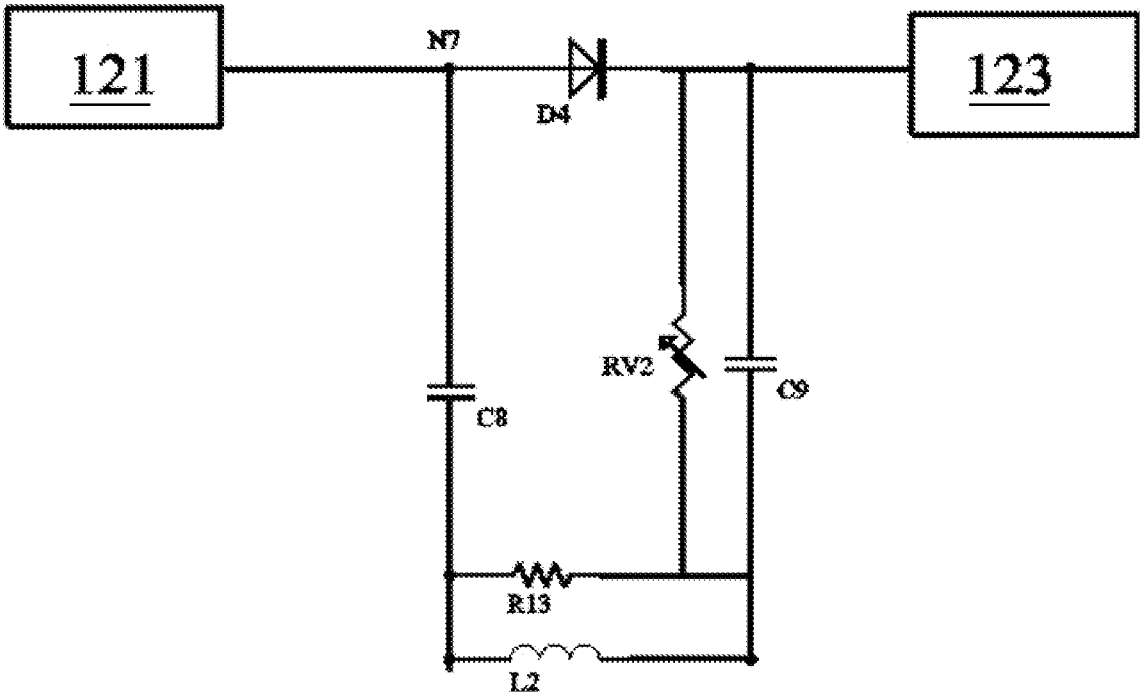
FIG. 8 schematically illustrates a circuit diagram of a filtering module according to an exemplary embodiment of the present invention.

FIG. 8 schematically illustrates a circuit diagram of a filtering module according to an exemplary embodiment of the present invention. As shown in FIG. 8, the filtering module includes a fourth diode D4, an eighth capacitor C8, a ninth capacitor C9, a thirteenth resistor R13, a second inductor L2, and a second adjustable resistor RV2. An input terminal of the fourth diode D4 is coupled with a first terminal of the eighth capacitor C8, and an output terminal of the fourth diode D4 is coupled with a first terminal of the second adjustable resistor RV2 and a first terminal of the ninth capacitor C9. A second terminal of the eighth capacitor C8 is coupled with a first terminal of the thirteenth resistor R13 and a first terminal of the second inductor L2. A second terminal of the ninth capacitor C9 is coupled with a second terminal of the second inductor L2, a second terminal of the thirteenth resistor R13, and a second terminal of the second adjustable resistor RV2.

Figure 10:
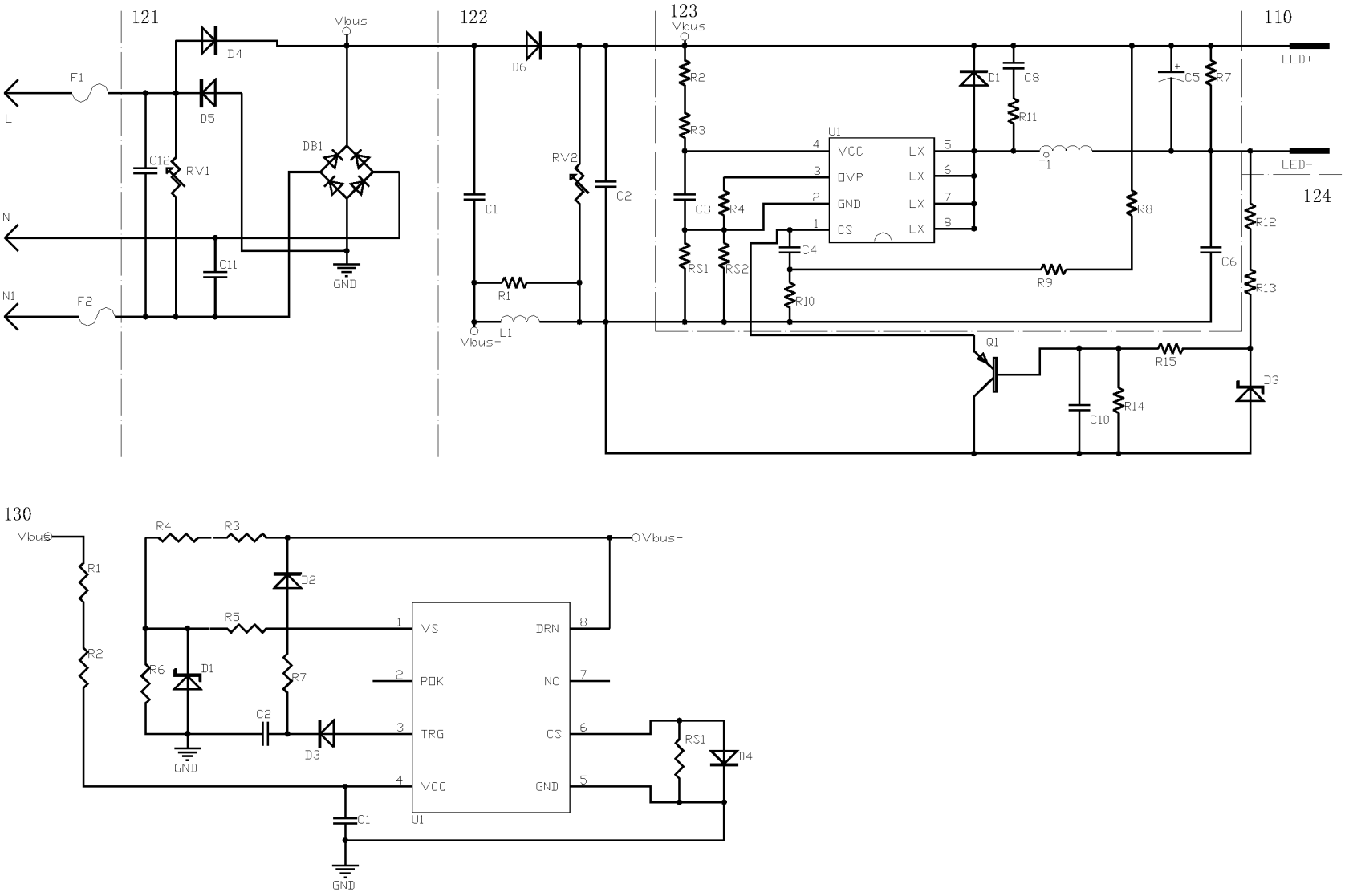
FIG. 10 schematically illustrates a circuit diagram of a lighting apparatus according to an exemplary embodiment of the present invention.

FIG. 10 schematically illustrates an overall circuit diagram of a lighting apparatus according to an exemplary embodiment of the present invention, wherein portions that are the same as the foregoing embodiments will not be described here in detail, instead, the following description will be focused on the circuit arrangement that is not mentioned above. It should be noted that, the dimming module in the embodiment shown in FIG. 10 is the same as that described in the embodiment shown in FIG. 3B. However, as will be understood by those skilled in the art, the embodiment shown in FIG. 3A is also applicable to the lighting apparatus shown in FIG. 10.

Conventionally, an LED lighting apparatus is powered at single end, while a traditional fluorescent lamp is powered at two ends. In order to replace the fluorescent lamp with the LED lighting apparatus with as little circuit modification as possible, it is necessary to configure the LED lighting apparatus to be powered at two ends, so as to make the applications of the LED lighting apparatus more diverse. In view of this, in the embodiments of the present invention, the lighting apparatus, in particular, the LED lighting apparatus has three input terminals to meet the cases of single-ended power supply and double-ended power supply.

Specifically, as shown in FIG. 10, the lighting apparatus 1000 includes a live input terminal L, a first neutral input terminal N, and a second neutral input terminal N'. The live input terminal L and the first neutral input terminal N are located on a first side of the lighting apparatus 1000, and the second neutral input terminal N' is located on a second side of the lighting apparatus 1000, wherein the first side is opposite to the second side. When the live input terminal L cooperates with the first neutral input terminal N, the lighting apparatus 1000 is powered at single end, and when the live input terminal L cooperates with the second neutral input terminal N', the lighting apparatus 1000 is powered at two ends.

Based on the configuration of the above input terminals, the lighting apparatus can be freely powered at single end and two ends, thus greatly broadening the applications of the lighting apparatus.

The inventor of the present invention has recognized that when the lighting apparatus 1000 is in a condition of double-ended power supply, there is a risk of electric shock if an operator accidentally touches the input terminal. In order to solve this problem, an embodiment of the present invention provides a mounted detection circuit 130 between the rectifier module and the filtering module, that is capable of controlling the turning on or off of the driving circuit. The mounted detection circuit 130 is configured to detect an electric signal abnormality in the driving circuit 120 in the case where the lighting apparatus 1000 is powered at two ends, and to turn off the driving circuit 120 in response to the detected abnormal electric signal. Exemplarily, FIG. 10 illustrates a circuit diagram of the mounted detection circuit 130 according to one embodiment of the present invention. However, as will be understood by those skilled in the art, other mounted detection circuit capable of preventing electric shock may also be employed. The mounted detection circuit 130 shown in FIG. 10 is coupled between the rectifier module and the filtering module of the lighting apparatus through the connection terminals Vbus and Vbus.

As will be understood by those skilled in the art, the term "coupled" includes not only a direct connection between electrical elements, but also various connection modes between electrical elements, such as direct and indirect electrical connections and magnetic couplings. Those skilled in the art will also recognize that the present invention is in no way limited to the exemplary embodiments described above. Instead, many modifications and variations are possible within the scope of the appended claims. For example, further components may be added to or removed from the described apparatus. Further embodiments may be within the scope of the invention. In addition, in the claim, the word "comprising" does not exclude other elements or steps. The simple fact that certain steps are recited in mutually different dependent claims does not mean that these steps cannot be combined.

What is claimed is:

1. A dimmable lighting apparatus, comprising a light emitting circuit and a driving circuit coupled with the tight emitting circuit, wherein the driving circuit comprises a rectifier module, a filtering module coupled between the light emitting circuit and the rectifier module, a constant current module coupled between the filtering module and the light emitting circuit, and a dimming module, and wherein the dimming module is configured to receive a driving signal supplied to the light emitting circuit from the constant current module, and feed the driving signal back to the constant current module to adjust an output power of the constant current module; and wherein the lighting apparatus further comprises a live input terminal, a first neutral input terminal and a second neutral input terminal, and wherein the live input terminal and the first neutral input terminal are located on a first side of the lighting apparatus, and the second neutral input terminal is located on a second side of the lighting apparatus, the first side being opposite to the second side, and wherein the live input terminal is configured to cooperate with the first neutral input terminal to supply power to the lighting apparatus at single end and to cooperate with the second neutral input terminal to supply power to the lighting apparatus at two ends.

2. The lighting apparatus according to claim 1, wherein the dimming module comprises a first voltage dividing unit, a filtering unit, a first voltage stabilizing unit and an amplifying unit, wherein the first voltage dividing unit is configured to collect the driving signal from the light emitting circuit, the filtering unit is configured to filter the collected driving signal, the amplifying unit is configured to amplify and feed back the filtered driving signal to the constant current module, and the first voltage stabilizing unit is configured to stabilize an input voltage of the amplifying unit.

3. The lighting apparatus according to claim 2, wherein, the first voltage dividing unit comprises a fifth resistor, a sixth resistor, a seventh resistor, and an eighth resistor, and wherein a first terminal of the fifth resistor is coupled with the light emitting circuit, a second terminal of the fifth resistor is coupled with a first terminal of the sixth resistor, a second terminal of the sixth resistor is coupled with a third node, a first terminal of the seventh resistor is coupled with the third node, a second terminal of the seventh resistor is coupled with a fourth node, a first terminal of the eighth resistor is coupled with the fourth node, and a second terminal of the eighth resistor is coupled to a ground;

the filtering unit comprises a third capacitor, and wherein a first terminal of the third capacitor is coupled with the fourth node, and a second terminal of the third capacitor is coupled to the ground;

the first voltage stabilizing unit comprises a second Zener diode, and wherein a positive pole of the second Zener diode is coupled to the ground, and a negative pole of the second Zener diode is coupled with the third node; and the amplifying unit comprises a second transistor, and wherein a base of the second transistor is coupled with the fourth node, a first pole of the second transistor is coupled to the ground, and a second pole of the second transistor is coupled with the constant current module.

4. The lighting apparatus according to claim 1, wherein the constant current module comprises a switch unit, a control unit coupled between the switch unit and the light emitting circuit, and an energy storage and freewheeling unit coupled between the control unit and the light emitting circuit.

5. The lighting apparatus according to claim 4, wherein the constant current module further comprises a second voltage dividing unit and a second voltage stabilizing unit, and wherein a first terminal of the second voltage dividing unit is coupled between the light emitting circuit and the energy storage and freewheeling unit, and a second terminal of the second voltage dividing unit is coupled with a first terminal of the second voltage stabilizing unit, and a second terminal of the second voltage stabilizing unit is coupled with the control unit.

6. The lighting apparatus according to claim 5, wherein the second voltage dividing unit comprises a ninth resistor, a tenth resistor, and an eleventh resistor, and wherein a first terminal of the ninth resistor is coupled between the light emitting circuit and the energy storage and freewheeling unit, a second terminal of the ninth resistor is coupled with a first terminal of the tenth resistor, a second terminal of the tenth resistor is coupled with a fifth node, a first terminal of the eleventh resistor is coupled with the fifth node, and a second terminal of the eleventh resistor is coupled with a sixth node; and the second voltage stabilizing unit comprises a fourth capacitor, and wherein a first terminal of the fourth capacitor is coupled with the control unit, and a second terminal of the fourth capacitor is coupled with the fifth node.

7. The lighting apparatus according to claim 4, wherein the energy storage and freewheeling unit comprises a first diode, a first inductor, a fifth capacitor and a twelfth resistor, and wherein a positive pole of the first diode is coupled with the control unit, a negative pole of the first diode is coupled with the light emitting circuit, a first terminal of the first inductor is coupled with the control unit, a second terminal of the first inductor is coupled with the light emitting circuit, a first terminal of the fifth capacitor is coupled with the light emitting circuit, and a second terminal of the fifth capacitor is coupled with a first terminal of the twelfth resistor, and a second terminal of the twelfth resistor is coupled with the control unit.

8. The lighting apparatus according to claim 4, wherein the switch unit comprises a power MOS transistor, and the power MOS transistor is integrated in the control unit.

9. The lighting apparatus according to claim 1, wherein the rectifier module comprises a second diode, a third diode, a sixth capacitor, a seventh capacitor, a first adjustable resistor, and a bridge rectifying circuit unit, and wherein an input terminal of the second diode is coupled with a first terminal of the sixth capacitor, a first terminal of the first adjustable resistor, and an output terminal of the third diode, an output terminal of the second diode is coupled with an output terminal of the bridge rectifying circuit unit, an input terminal of the third diode is coupled to a ground, a second terminal of the sixth capacitor is coupled with a second terminal of the first adjustable resistor, a first terminal of the seventh capacitor, and a first input terminal of the bridge rectifying circuit unit, a second terminal of the seventh capacitor is coupled with a second input terminal of the bridge rectifying circuit unit, and a third input terminal of the bridge rectifying circuit unit is coupled to the ground.

10. The lighting apparatus according to claim 1, wherein the filtering module comprises a fourth diode, an eighth capacitor, a ninth capacitor, a thirteenth resistor, a second inductor, and a second adjustable resistor, and wherein an input terminal of the fourth diode is coupled with a first terminal of the eighth capacitor, an output terminal of the fourth diode is coupled with a first terminal of the second adjustable resistor, and a first terminal of the ninth capacitor, a second terminal of the eighth capacitor is coupled with a first terminal of the thirteenth resistor, and a first terminal of the second inductor, and a second terminal of the ninth capacitor is coupled with a second terminal of the second inductor, a second terminal of the thirteenth resistor, and a second terminal of the second adjustable resistor.

11. The lighting apparatus according to claim 1, wherein the driving circuit further comprises a mounted detection circuit coupled between the rectifier module and the filtering module, and wherein the mounted detection circuit is configured to detect an electric signal abnormality in the driving circuit in a case where the lighting apparatus is powered at two ends, and to turn off the driving circuit in response to the detected abnormal electric signal.

12. The lighting apparatus according to claim 1, wherein the lighting apparatus is adaptable to a Triac dimmer.

13. The lighting apparatus according to claim 1, wherein the lighting apparatus is an LED lamp.

14. The lighting apparatus according to claim 13, wherein the LED lamp comprises a lamp body and end caps located at two ends of the lamp body, and each of the end caps is provided with pins.

* * * * *